US005508477A

United States Patent [19]

Kato et al.

[11] Patent Number: 5,508,477

[45] Date of Patent: Apr. 16, 1996

[54] APPARATUS FOR ACOUSTIC NOISE REDUCTION OF OFFICE AUTOMATION DEVICES UTILIZING HELMHOLTZ RESONANCE THEORY

[75] Inventors: Masahiko Kato; Naoki Kozuka, both of Yokohama, Japan

[73] Assignee: Ricoh Co., Ltd., Tokyo, Japan

[21] Appl. No.: 361,367

[22] Filed: Dec. 22, 1994

[30] Foreign Application Priority Data

Dec. 22, 1993 [JP] Japan ..... 5-323002

[51] Int. Cl.$^6$ ..... G10K 11/00

[52] U.S. Cl. ..... 181/205; 181/225

[58] Field of Search ..... 181/225, 201, 181/205, 206, 224; 381/71; 400/689, 690

[56] References Cited

U.S. PATENT DOCUMENTS 4,215,762 8/1980 Cunningham et al. ..... 181/201

4,729,452 3/1988 Sims ..... 181/201

4,807,718 2/1989 Lotz ..... 181/202

*Primary Examiner*—Khanh Dang

*Attorney, Agent, or Firm*—Oblon, Spivak, McClelland, Maier & Neustadt

[57] ABSTRACT

An acoustic noise reduction apparatus for an office automation device is provided on a surface of an outer shield of the office automation device and has a hole therethrough. The body member of the apparatus defines an internal volume which covers the hole. A control member is operatively connected with the body member and divides the body member into a hollow portion, a duct portion, and a silencer portion. The hollow portion and the duct portion form a Helmholtz resonator within the body member.

13 Claims, 7 Drawing Sheets

APPARATUS FOR ACOUSTIC NOISE REDUCTION OF OFFICE AUTOMATION DEVICES UTILIZING HELMHOLTZ RESONANCE THEORY

BACKGROUND OF THE INVENTION

1. Field of the Invention

This invention relates to the field of OA (office automation) devices, such like a copying machine, a facsimile, a laser printer and so on, and in particular to an apparatus for acoustic noise reduction of the OA devices.

2. Description of the Prior Art

According to the development of technology and the demand for an improvement of the efficiency of office work, OA devices, such as a copying machine, a facsimile, or a laser printer and so on, are becoming more popular in many office environments.

In the operation of OA devices, acoustic noise is generated. In some situations, the noise might reduce an efficiency of the office work. Due to increased use of OA devices, it becomes more important to reduce the acoustic noise generated by OA devices for efficient office work.

Generally, one effective solution for reducing acoustic noise is to prevent the leakage of the noise from a noise source by sealing the noise source.

A conventional device for reducing acoustic noise generated from the OA devices is disclosed in Japanese Patent Laid-Open Publication No. 4(1992)-469. This publication discloses a laser printer and is designed to reduce the noise which is generated by a gear member which adjoin the image development unit. According to this publication, this laser printer is provided with a soundproof shield which covers the gear member which adjoins the development unit, and a hollow type of silencer member is provided in the hole of the soundproof shield to seal up the noise source, such as the gear member.

But the OA devices usually have an inlet hole for cooling air, sometimes with a fan unit. Furthermore, they require openings through the outer shield of the OA devices to feed a paper from a paper storage unit to a image development unit therein, and to output the paper therefrom after image development has been completed. These openings leak acoustic noise generated by the noise source in the OA device, such as a gear member or a cooling unit. The abovementioned device does not account for the openings necessary for a flow of air for cooling the inside of the device and the paper feed operation of the device. For these reasons, it is hard to effectively reduce the acoustic noise of the OA devices using the above mentioned devices.

Another apparatus is disclosed in Japanese Patent Laid-Open Publication No. 4(1992)-221965. It discloses an image forming apparatus comprising a system having an active noise cancellation system. But this system requires expensive components to control the noise of the image forming apparatus. The system needs a microphone unit to input the acoustic noise information, a speaker unit to output corrective acoustic signals, and high performance signal processing unit with memory. So this apparatus does not have adaptability to general OA devices and could not be used for low cost OA devices.

Another known device is shown in FIG. 13*a* and 13*b*. This apparatus utilizes an acoustic noise insulation device, such like a glass wool or a forming member. This apparatus is provided on an outer shield 71 of the OA device, which shield is provided a hole 71*a* for the flow of the air. It includes a cover member 72 which covers the hole 71*a*. The cover member 72 has an internal volume with an open end. Although the device of FIGS. 13*a* and 13*b* is not described as an acoustic noise insulation device, the cover member 72 is covered with internal insulation and so acts as a silencer. It permits air flow within the OA device and so reduces the transmitted noise to outside of the OA device.

As well known in this technical field, the frequency band for which the acoustic noise insulation device is effective is near 1 kHz. But the frequency of most powerful acoustic noise generated by the cooling fan unit is in the neighborhood of about several hundred Hz. This figure is a multiple of the number of fan blades and the rotational speed of the fan. A main noise frequency generated by the gear member which adjoins the image development unit is also several hundreds Hz.

So this type of silencer is ineffective for attenuating acoustic noise in the frequency band of the main acoustic noise generated in the OA device, and it is not adequate for noise reduction.

SUMMARY OF THE INVENTION

Accordingly, one object of this invention is to provide a novel and efficient apparatus for acoustic noise reduction in OA devices. A further object of this invention is to provide a more general apparatus for acoustic noise reduction of OA devices which does not prevent the flow of cooling air inside the OA device, has wide adaptability to other OA devices, and is easily modified for use with other OA device. The acoustic noise reduction of the present invention is based on Helmholtz resonance theory. It therefore uses a resonance of the acoustic wave to attenuate the amplitude of certain frequency bands. According to the invention, a body member covers a hole of a soundproof shield of the OA device. The body member has an internal volume with an open end to permit air flow for cooling the OA device. A control member divides internal volume into a hollow portion, a duct portion, and a silencer portion. The duct portion and the hollow portion form a Helmholtz resonator inside the body member. The acoustic noise generated in the OA device is effectively attenuated by the Helmholtz resonator. The control member may have an adjustable parameter in order to tune the Helmholtz resonator to the main frequency of the generated noise.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention may be implemented as part of an OA devices such as a copying machines, a facsimiles, a laser printer and so on. In the following description, specific details are set forth in order to provide a through understanding of the invention. It will be apparent, however, to one skilled in the art that the present invention may be practiced without such specific details. In other instances, well known components of OA devices, for example image forming components or image recording medium delivering components, have not been shown in detail in order not to unnecessarily obscure the invention.

Figure 1A:
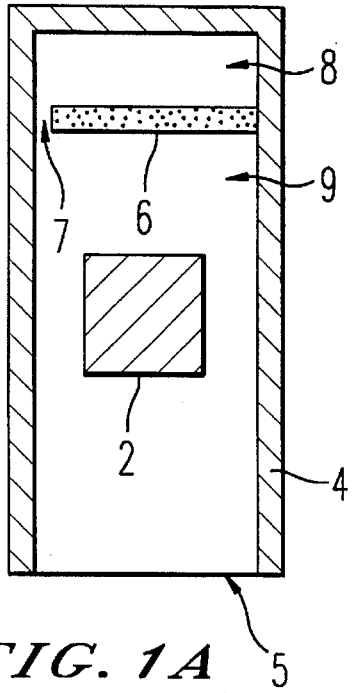
FIG. 1*a* and 1*b* are front and side views of a first embodiment of the present invention which forms a Helmholtz resonator.
Figure 1B:
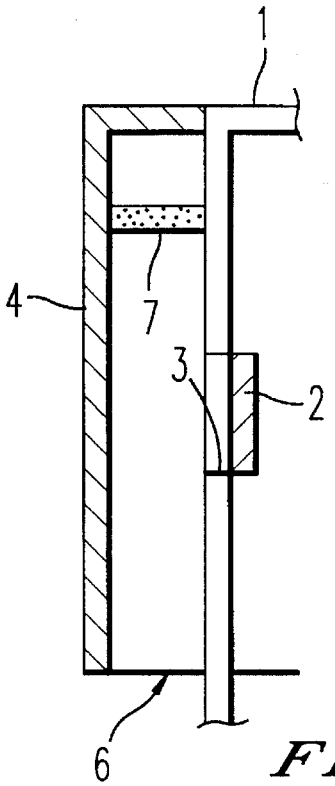

Referring now to the drawings, wherein like reference numerals designate identical or corresponding parts throughout the several views, and more particularly to FIG. 1 thereof, FIG. 1*a* and FIG. 1*b* illustrates in vertical elevation in section, front and side views of an embodiment of the present invention.

An outer shield 1 covers an OA device and has a noise source 2 such as a cooling fan unit. The outer shield 1 also has at least one hole 3 permitting a flow of cooling air into the OA device.

A body member 4 of the acoustic noise reduction apparatus is provided on a surface of the outer shield 1 and covers the hole 3. The body member 4 defines an internal volume with a predetermined capacity. The body member 4 has an open end 5 through which cooling air can flow to reach the hole 3.

A control member 6 within the body member 4 divides the internal volume of the body member 4 into a duct portion 7, a hollow portion 8, and a silencer portion 9. The hollow portion 8 is connected with the silencer portion 9 through the duct portion 7. Put another way, the control member 6 divides the internal volume into the hollow portion 8 and the silencer portion 9, and the control member 6 forms the duct portion 7 between the hollow portion 8 and the silencer portion 9.

The control member 6 partitions the internal volume and controls the size of the duct portion 7 and the capacity of the hollow portion 8 for forming a Helmholtz resonator in the body member 4. The reduction of the acoustic noise of the present invention is based on Helmholtz resonance theory.

The silencer portion 9 includes the hole 3 through the outer shield 1 and the body member 4, and extends from the duct member 7 to the open end 5. The silencer portion 9 is preferably internally covered with an acoustic noise insulation device.

The cooling air for the OA device flows out from the hole 3, through the open end 5 and is thereby discharged from the OA device. Simultaneously, a portion of the air is discharged to the hollow portion 8 through the duct portion 7.

The acoustic noise which is leaked from the hole 3 is attenuated by its transmission through the silencer portion 9. Simultaneously, a portion of the acoustic noise is transmitted to the hollow portion 8 through the duct portion 7. As previously described, the duct portion 7 and the hollow portion 8 make up a Helmholtz resonator. So the acoustic noise which is transmitted to the hollow portion 8 through the duct portion 7 creates acoustic resonance in the hollow portion 8. This acoustic resonance attenuate the power of acoustic noise in the hollow portion.

Helmholtz resonance theory is well-known art in the field of the acoustic information processing. For example, this theory of resonance is disclosed in a book written by *Siraki*, "Noise Preventive Planning and Simulation," published on Apr. 18, 1987 which is hereby incorporated by reference.

Figure 2:
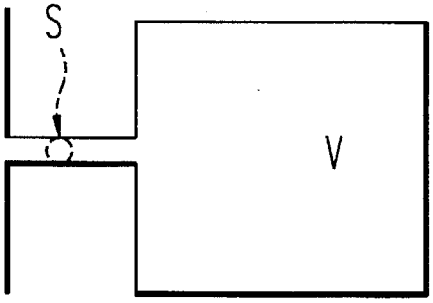
FIG. 2 is a conceptually illustrates a Helmholtz resonator.

Referring to FIGS. 1*a* and 1*b*, and FIG. 2, which is the conceptual diagram of a Helmholtz resonator, the structure of the Helmholtz resonator of the present invention will be explained.

In the embodiment of FIGS. 1*a* and 1*b*, the size (S) of the duct portion 7 and the capacity (V) of the hollow portion 8 are defined by the following expressions (1) and (2), based on the referenced characters in FIG. 1*a* and 1*b*.

$$S=X\times Th \tag{1}$$

$$V=Lh\times Wh\times Th \tag{2}$$

Referring to FIG. 2, according to Helmholtz resonance theory, the resonance frequency (fh) of the Helmholtz resonator is defined by the size of the duct (S), the length of the duct (Lb), the capacity of the hollow (V), and the sound velocity (C). When substituting the parameter of FIG. 1*a* and 1*b*, the resonance frequency (fh) is:

$$fh=\frac{c}{2\pi}\sqrt{\frac{S}{VLb}}=\frac{c}{2\pi}\sqrt{\frac{X}{LbLhWh}} \tag{3}$$

Figure 3:
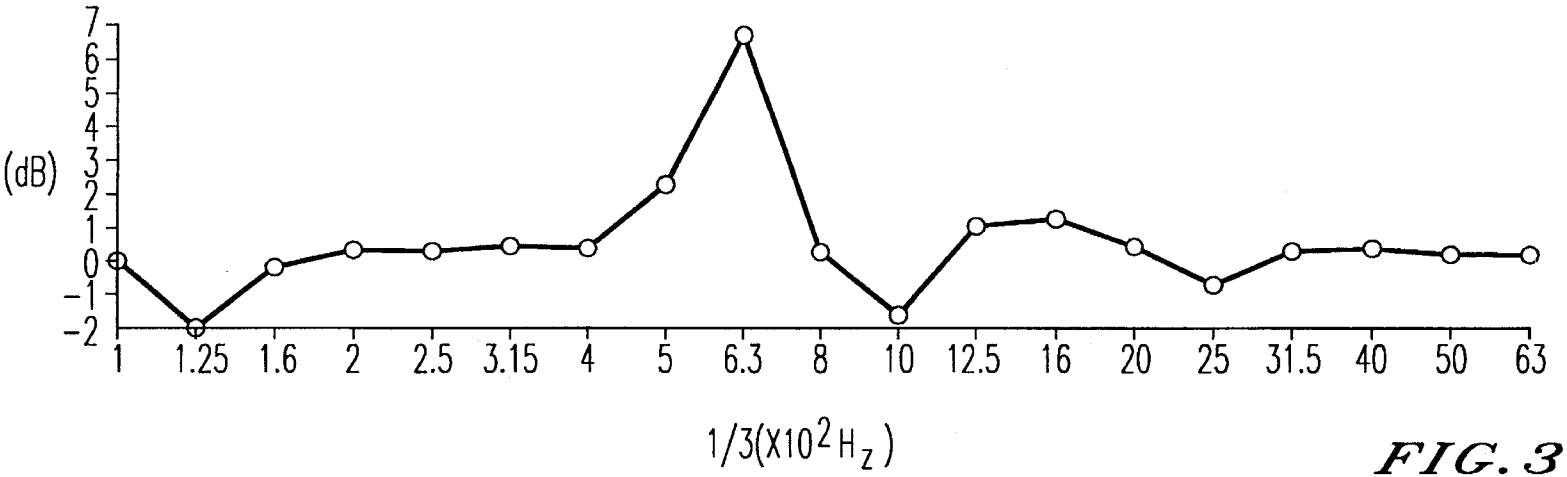
FIG. 3 graphically illustrates the results of an experiment which explain the reduction of acoustic noise by use of the present invention.

For example, FIG. 3 shows an experimental result of the acoustic noise reduction due to the present invention. It shows the difference in noise level when a Helmholtz resonator is formed inside of the body member 4 and when it is not present. This experimental result is based on the following values for the referenced characters of FIG. 1: Lh=65 (mm), Wh=65 (mm), Th=45 (mm), Lb=5 (mm), X=2.5 (mm). So the resonance frequency fh=657 (Hz) is defined by the above mentioned expression (3). An acrylic resin board of 5 (mm) thickness was used as the body member 4 in this experiment. As a result of this experiment, a maximum noise reduction was 6.6 (dB) at 630 (Hz), and an average noise reduction from 100 (Hz) to 6300 (Hz) was 2.9 (dB). The invention was therefore able to effectively reduce the main frequency band of acoustic noise of the OA device.

The present invention efficiently reduces acoustic noise by use of a Helmholtz resonator and does not prevent cooling air flow inside of the OA device. Accordingly, there is no need for an expensive system. Furthermore, it has wide adaptability to the other OA devices.

In place of the noise source which involves the flow of air, it is also possible to use the present invention to control another noise source such as a gear member. In the case of the noise sources which do not involve the air flow, there is no need to provide the open end 5.

Figure 4B:
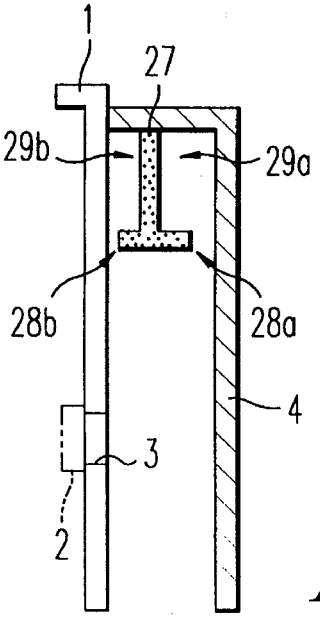
FIG. 4*a* and 4*b* are side views of two versions of second embodiment of the present invention, which forms plurality of Helmholtz resonators.
Figure 4A:
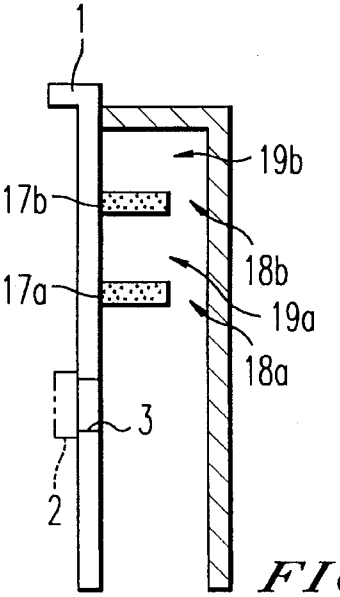

A second embodiment of this invention is shown in cross section in FIGS. 4(*a*) and 4(*b*). In this embodiment, the control member is provided so as to form a plurality of Helmholtz resonators in the internal volume of the body member 4. In the following description, only the components which are different from the first embodiment are described.

In case of FIG. 4(*a*), control members 17*a* and 17*b*, each corresponding to the control member 6 of the first embodiment, are provided perpendicularly to the surface of the outer shield 1. The control member 17*a* forms a duct portion 18*a* and a hollow portion 19*a*. Similarly, the control member 17*b* forms a duct portion 18*b* and a hollow portion 19*b*.

In the case of FIG. 4(*b*), a control member 27, which looks like "T" character in cross section, is provided in the internal volume, and forms a plurality of duct portion 28*a* and 28*b*, and hollow portion 29*a* and 29*b*.

In the above mentioned embodiments, the control member is provided to control the duct size and the capacity of the hollow portion, to make up a plurality of Helmholtz resonators. The position of the control member defines the frequency of the Helmholtz resonator based on the above mentioned expressions (1) to (3). Therefore, it is possible to get different resonance frequencies from the plurality of Helmholtz resonators. So, according to this embodiment, it is possible to deal with a wide range of acoustic noise from the OA device. For example, it is easy to control the first resonance frequency for the cooling fan noise, and the second resonance frequency for the neighborhood of the cooling fan.

Generally, the frequency of acoustic noise generated by the OA device changes with the status and componentry of the OA device. For example, the noise frequency during the operation of the cooling fan unit or the gear member is different from that during stand-by status or the type of the OA device therein.

Figure 5:
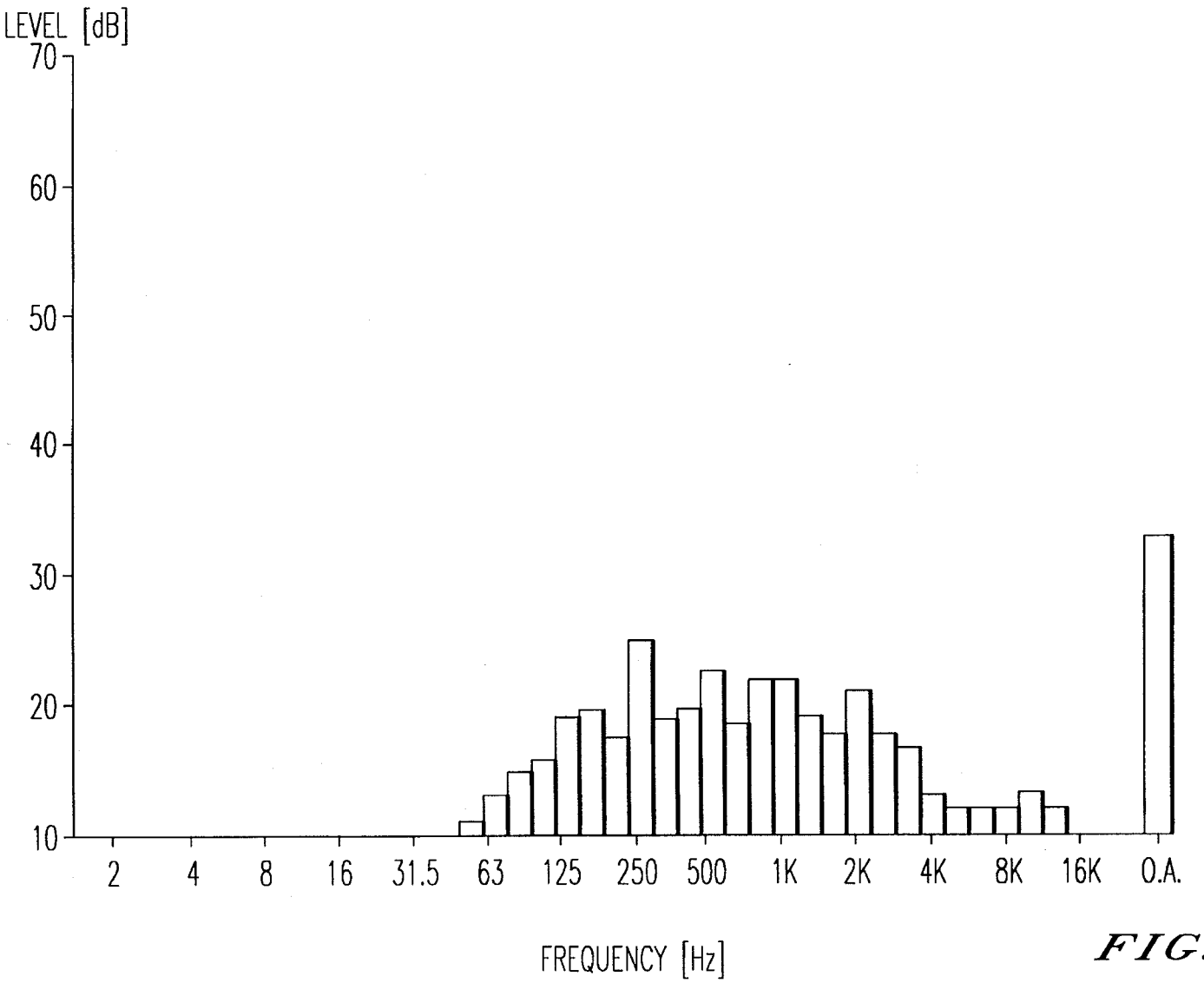
FIG. 5 is a frequency dispersion diagram of acoustic noise generated by an OA device which is in stand-by status.
Figure 6:
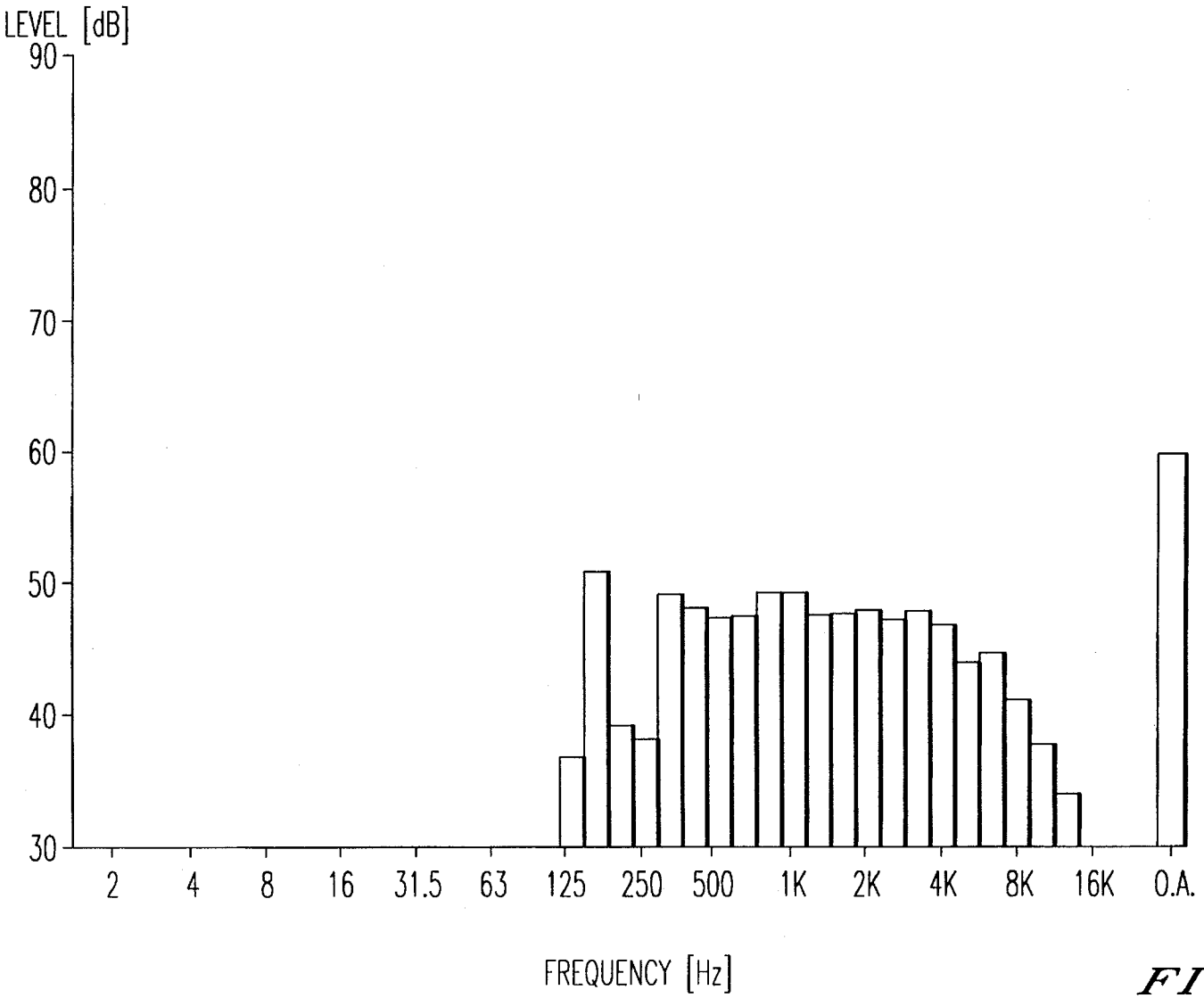
FIG. 6 is a frequency dispersion diagram of acoustic noise generated by an OA device which is in operating status.

FIG. 5 and FIG. 6 illustrate this difference of the frequency dispersions of the acoustic noise in ⅓ octave analysis. FIG. 5 is a frequency dispersion diagram of an OA device which is in stand-by status. In this diagram, the peak of frequency dispersion is at 250 Hz, which represents a multiple of the blade number of a fan and the rotation speed of the fan. FIG. 6 describes a frequency dispersion diagram of same OA device, which is in operating status. According to this diagram, it has a peak at 160 Hz.

Figure 7:
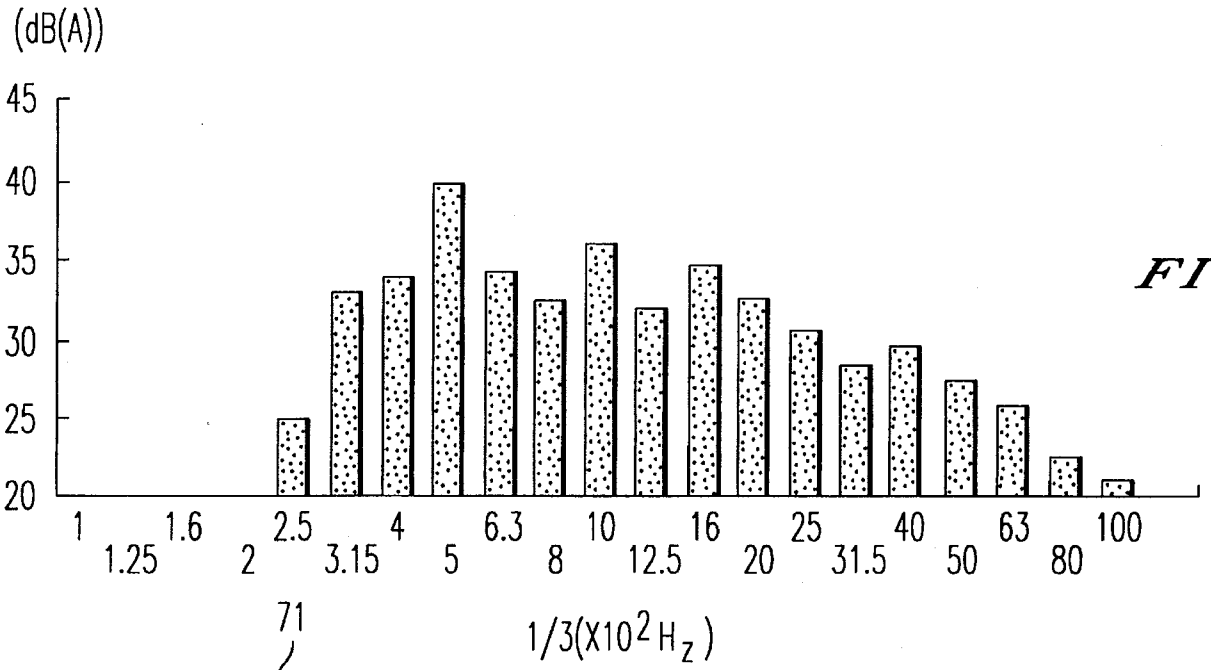
FIG. 7 is a frequency dispersion diagram of acoustic noise generated by another OA device which is in stand-by status.
Figure 13B:
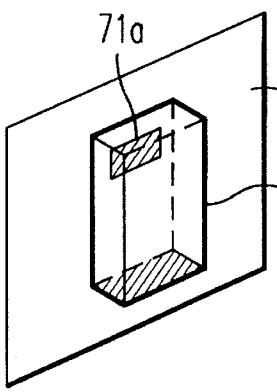
FIG. 13B PRIOR ART
FIG. 13*a* and 13*b* illustrate a conventional silencer utilizing an acoustic noise insulation device.
Figure 13A:
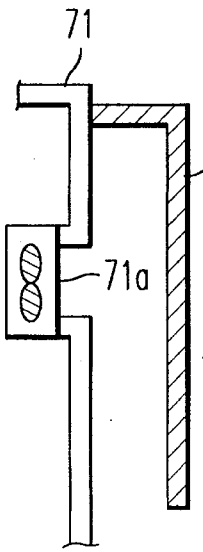
FIG. 13A PRIOR ART
Figure 8:
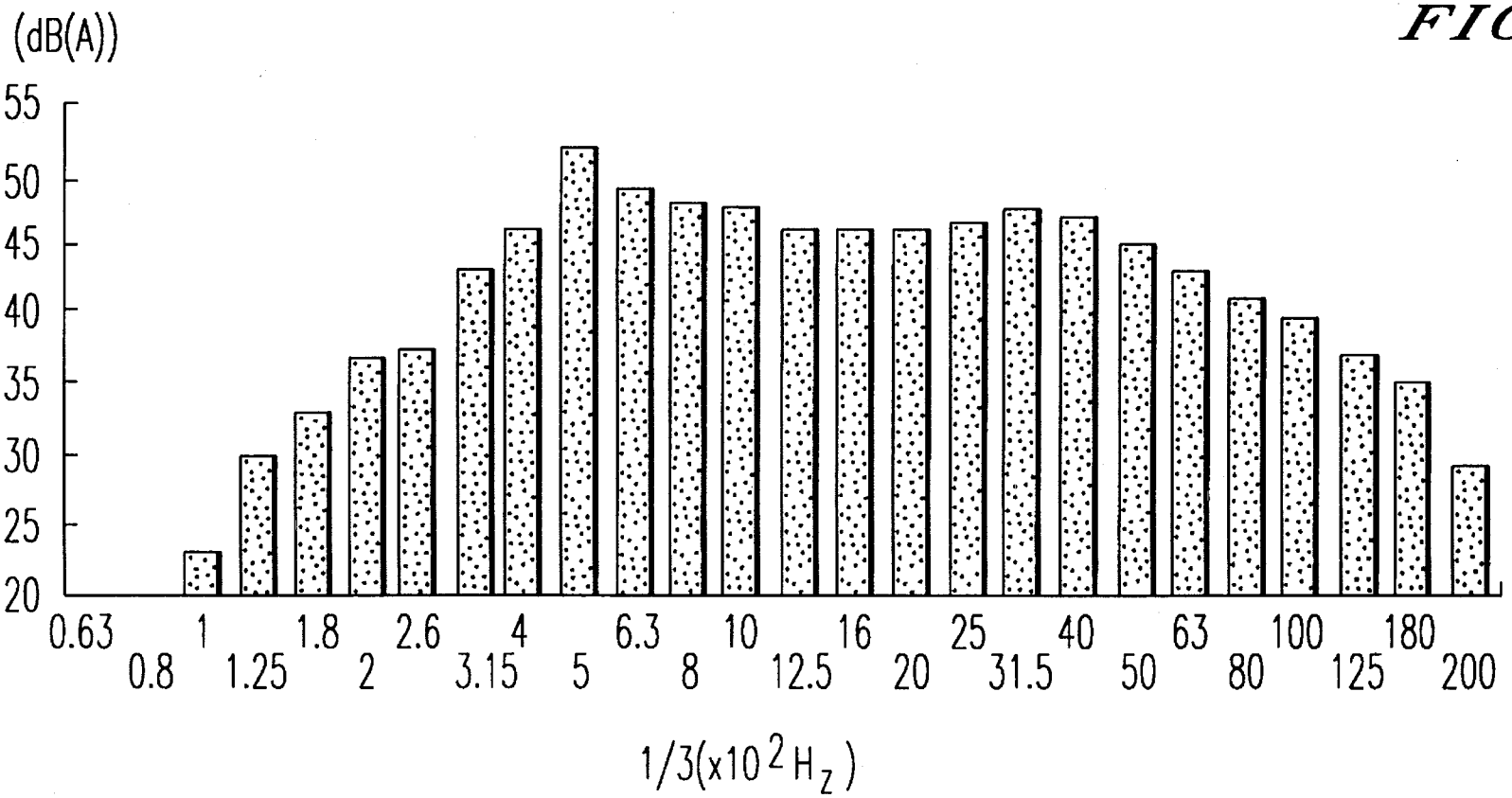
FIG. 8 is a frequency dispersion diagram of acoustic noise generated by the another OA device which is in operating status.

FIG. 7 and FIG. 8 show the frequency dispersions of the acoustic noise of another OA device. FIG. 7 is a frequency dispersion diagram of the stand-by status and FIG. 8 is a frequency dispersion diagram of the operating status of same OA device. According to FIG. 7 and FIG. 8, the peak frequency dispersion of the stand-by status of this OA device is at 500 Hz, and the operating status thereof is also at 500 Hz, but with a higher amplitude.

These characteristics of the frequency dispersion are mainly based on different components of the OA device, such as a fan unit or gear members. And there may be some dispersion change due to circumstances, such as when the OA device is setting up. Therefore, it is efficient for acoustic noise reduction to tune the target frequency range based on the type and the status of the OA device.

Figure 9A:
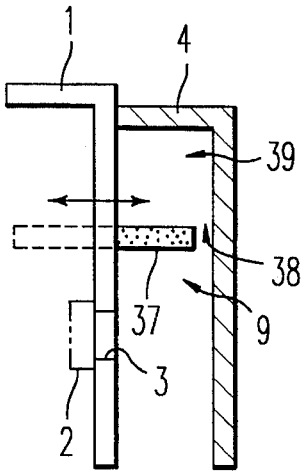
FIGS. 9*a* and 9*b* are side and perspective views of a third embodiment of the present invention which controls the size of the duct portion in a Helmholtz resonator.
Figure 9B:
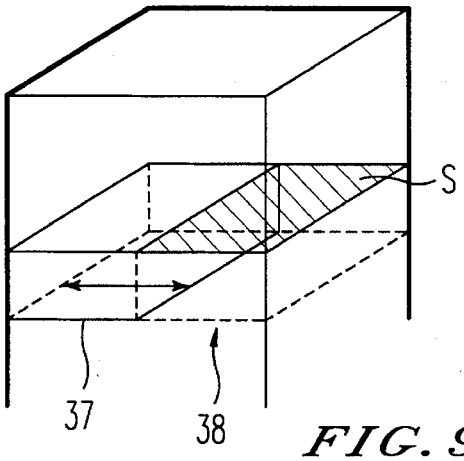

The third embodiment of this invention is shown in a side elevation section in FIG. 9(*a*) and a partial perspective view in 9(*b*). In this embodiment, a control member 37 is provided in the body member 4 to form a Helmholtz resonator with a duct member 38 and a hollow member 39. Further, the control member 37 is movable in a direction approximately perpendicularly with respect to the surface of the outer shield 1. So the control member 37 can be moved (adjustable parameter) to change the size of the duct portion 38. It is therefore easy to change the main resonance frequency of Helmholtz resonator so as to tune the main reduction frequency based on the status of implemented OA device. For example, in the stand-by status of the implemented OA device, the Helmholtz resonator could be tuned to a first resonance frequency for the noise of the stand-by status. And it is easy to change the resonance frequency for the operating status by moving the control member 37.

Figure 10:
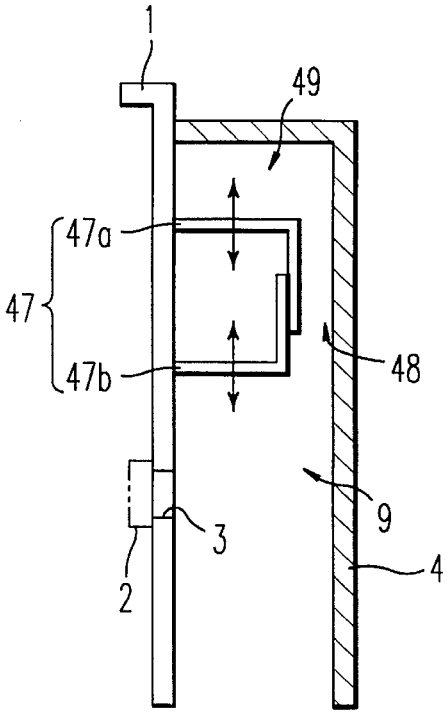
FIG. 10 is a side view of fourth embodiment of the present invention, which control the length of the duct portion and the capacity of the hollow portion in a Helmholtz resonator.

The fourth embodiment of this invention is shown in a side elevation section in FIG. 10. In this embodiment, the control member 47 is formed from a combination of members 47*a* and 47*b*, which look like "L" characters in the cross section view and link with each other. Each component of the control member 47 is able to move in the predetermined straight line direction on the outer shield which is shown by the arrows in FIG. 8 (adjustable parameter). The control member 47 controls the length of the duct portion 48 and the capacity of the hollow member 49. It is therefore easy to change the resonance frequency of the Helmholtz resonator and to tune the main reduction frequency with respect to the status of the implemented OA device.

Figure 11:
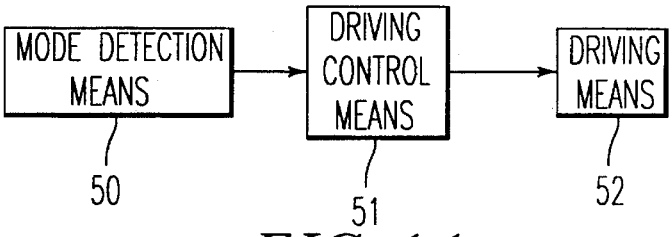
FIG. 11 is a functional block diagram of fifth embodiment of the present invention, which includes noise detection means.

It is favorable to apply the abovementioned embodiment to various implementations of an active noise reduction system. For example, FIG. 11 is a functional block diagram of an active noise reduction system according to this invention. This embodiment of the active noise reduction system comprises a noise detection means 50, a driving control means 51 and a driving means 52.

The noise detection means 50 may be implemented by a microphone and a signal sampling means such like A/D converter, for detecting the frequency of the acoustic noise of the OA device. The driving control means 51 implemented by a MPU (micro processor unit) and a ROM (read only memory). The MPU determines a desired value of X or Lb based on the most significant frequency of the acoustic noise detected by the noise detection means 50, and so derives a driving amount of the control member 37 or 47 with reference to data stored in the ROM. The driving means 52 drives the control member based on the driving amount processed by the driving control means 51 to match the resonance frequency of the Helmholtz resonator with the most significant frequency of the detected acoustic noise.

Figure 12:
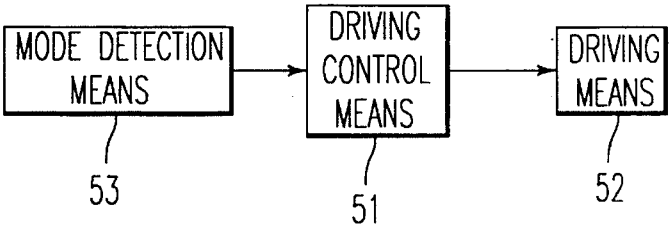
FIG. 12 is a functional block diagram of sixth embodiment of the present invention, which includes mode detection means.

FIG. 12 shows another functional block diagram of an application of this invention. This embodiment of the active noise reduction system comprises a mode detection means 50, a driving control means 51, a driving means 52.

The mode detection means 50 detects an operation mode which represents the operation status of the OA device, such as stand-by status or copying status. It is easy to implement the mode detection means 50 based on the central control unit of the OA device. The driving control means 51 and the driving means 52 could be implement by the same component described in FIG. 11. However, alternative structure to control the Helmholtz resonance frequency would not depart from the spirit and scope of the present invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An acoustic noise reduction apparatus for an office automation device having an outer shield and a hole through the outer shield, said apparatus comprising:

a body member mounted on a surface of said outer shield so as to cover said hole, said body member enclosing an internal volume communicating with said hole;

a control member positioned in said body member so as to divide said internal volume into a hollow portion, a duct portion and a silencer portion, wherein said duct portion communicates said hollow portion and said silencer portion one another, and wherein said hollow portion and said duct portion form a Helmholtz resonator within said body member.

2. An apparatus as recited in claim 1 said body member has an open end.

3. An apparatus as recited in claim 2 wherein said hole and said open end are associated with said silencer portion.

4. An apparatus as recited in claim 1 wherein said control member is adjustably configured so as to modify at least one of the capacity of said hollow portion and a parameter of said duct portion and to thereby adjust a resonant frequency of said Helmholtz resonator.

5. An apparatus as recited in claim 4 wherein said control member is adjustably configured so as to modify the size of said duct portion.

6. An apparatus as recited in claim 4 wherein said control member is adjustably configured so as to control the length of said duct portion and the capacity of said hollow portion.

7. An apparatus as recited in claim 4, including driving means for driving said control member so that the adjustable configuration of said control member is such that the resonance frequency of said Helmholtz resonator approaches the most significant frequency of acoustic noise from said office automation device.

8. An apparatus as recited in claim 7 including driving control means responsive to a detected status of the office automation device for controlling said driving means.

9. An apparatus as recited in claim 7 including driving control means responsive to a detected noise frequency for controlling said driving means.

10. An apparatus as recited in claim 1 wherein said control member forms a plurality of Helmholtz resonators within said body member.

11. An apparatus as recited in claim 10 wherein said plurality of Helmholtz resonators have at least two resonance frequencies.

12. An acoustic noise reduction apparatus for an office automation device having an outer shield and a hole through the outer shield, said apparatus comprising:

a noise detection means for detecting a frequency dispersion of acoustic noise from the office automation device;

a body member mounted on a surface of said outer shield so as to cover said hole, said body member enclosing an internal volume communicating with said hole;

a control member positioned in said body member, so as to divide said internal volume into a hollow portion, a duct portion, and a silencer portion, wherein said duct portion communicates said hollow portion and said silencer portion with one another, and wherein said hollow portion and said duct portion form a Helmholtz resonator within said body member, said control member having at least one parameter which is adjustable so as to adjust a resonance frequency of said Helmholtz resonator; and driving means for adjusting said parameter as a function of the detected frequency dispersion.

13. An acoustic noise reduction apparatus for an office automation device having an outer shield and a hole through the outer shield, said apparatus comprising:

status detection means for detecting a status of the office automation device;

a body member mounted on a surface of said outer shield so as to cover said hole, said body member enclosing an internal volume communicating with said hole;

a control member positioned in said body member, so as to divide said internal volume into a hollow portion, a duct portion, and a silencer portion, wherein said duct portion communicates said hollow portion and said silencer portion with one another, and wherein said hollow portion and said duct portion form a Helmholtz resonator within said body member, said control member having at least one parameter which is adjustable so as to adjust a resonance frequency of said Helmholtz resonator; and driving means for adjusting said parameter as a function of the detected frequency dispersion.

* * * * *